US007124785B2

(12) United States Patent
Barden

(10) Patent No.: US 7,124,785 B2
(45) Date of Patent: Oct. 24, 2006

(54) FORMER ASSOCIATED WITH AN APPARATUS FOR MAKING CAGES

(75) Inventor: Wayne Barden, Eagleby (AU)

(73) Assignee: Cagemaker Equipment Pty. Ltd., Eagleby (AU)

( * ) Notice: Subject to any disclaimer, the term of this patent is extended or adjusted under 35 U.S.C. 154(b) by 222 days.

(21) Appl. No.: 10/470,270

(22) PCT Filed: Feb. 8, 2002

(86) PCT No.: PCT/AU02/00124

§ 371 (c)(1),
(2), (4) Date: Aug. 7, 2003

(87) PCT Pub. No.: WO02/064906

PCT Pub. Date: Aug. 22, 2002

(65) Prior Publication Data

US 2004/0099330 A1 May 27, 2004

(30) Foreign Application Priority Data

Feb. 9, 2001 (AU) ..... PR 3003

(51) Int. Cl.
*B21F 27/10* (2006.01)

(52) U.S. Cl. ..... 140/112

(58) Field of Classification Search ..... 140/92.1, 140/92.2, 112; 301/57; 29/897.34, 700; 52/167.1, 167.4; 219/56, 127
See application file for complete search history.

(56) References Cited

U.S. PATENT DOCUMENTS 1,411,382 A * 4/1922 Rupe ..... 301/57
1,488,340 A * 3/1924 Gustafson ..... 301/57
3,579,259 A * 5/1971 Kato ..... 219/56
4,625,773 A 12/1986 Pfender
5,271,436 A 12/1993 Pfender et al.
6,148,873 A * 11/2000 Mehre ..... 140/112
6,223,785 B1 * 5/2001 Barden ..... 140/112

FOREIGN PATENT DOCUMENTS

| | | |
|---|---|---|
| AU | 439402 | 8/1973 |
| AU | 1999/64426 | 6/2000 |
| DE | 23 60 532 | 6/1975 |
| EP | 0035477 | 9/1981 |
| EP | 196542 A2 * | 10/1986 |
| EP | 0 955 423 | 10/1999 |
| GB | 2 310 875 | 10/1997 |
| WO | WO 00/45008 | 3/2000 |

* cited by examiner

*Primary Examiner*—Dmitry Suhol
(74) *Attorney, Agent, or Firm*—Hoffman, Wasson & Gitler

(57) ABSTRACT

A former (10) for a reinforced concrete cage making machine, adapted to hold a plurality of longitudinally extending rods is disclosed, the former (10) including a frame comprising an inner frame (21), an outer frame (20) and transverse frame members (22), and a plurality of rod supports (11), each rod support (11) adapted to hold an associated longitudinally extending rod, wherein the rod supports (11) are mounted to the frame (21, 20, 22) such that the transverse location of at least one of the rod supports (11) can be varied, relative to the frame (21, 20, 22).

24 Claims, 8 Drawing Sheets

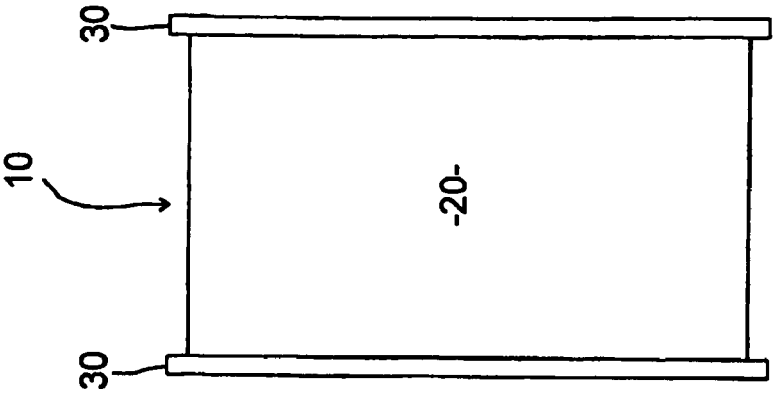
FIG. 1B
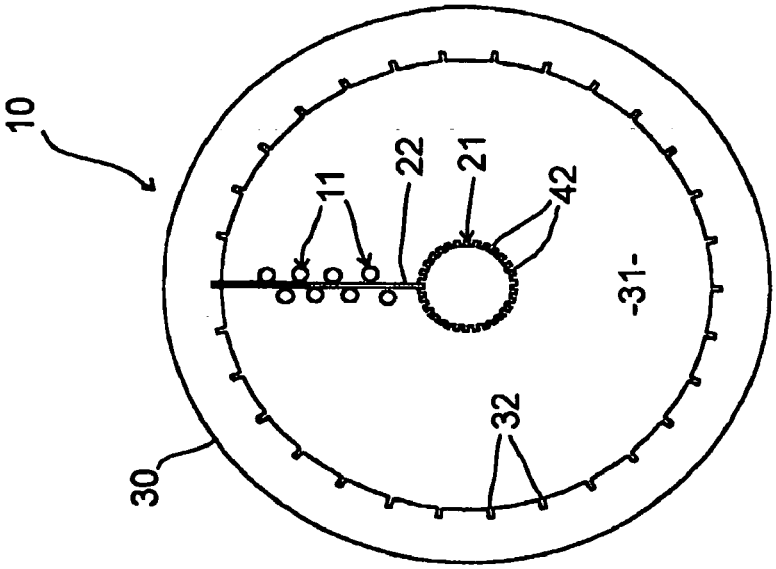
FIG. 1A
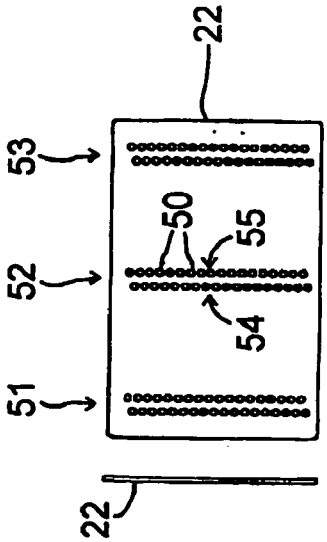
FIG. 2A
FIG. 2B
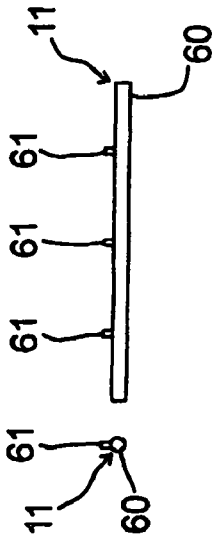
FIG. 3A
FIG. 3B

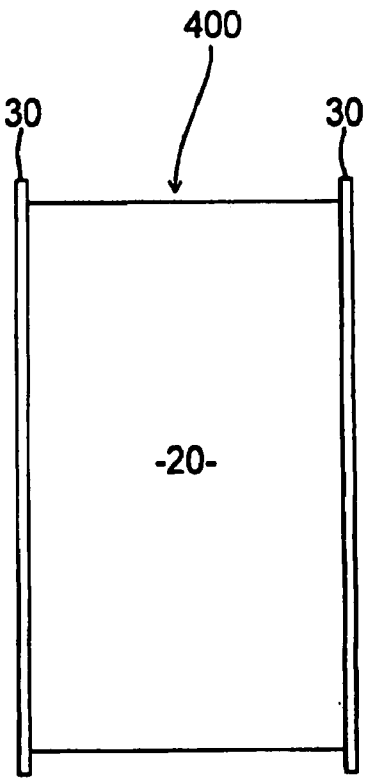
FIG. 11B
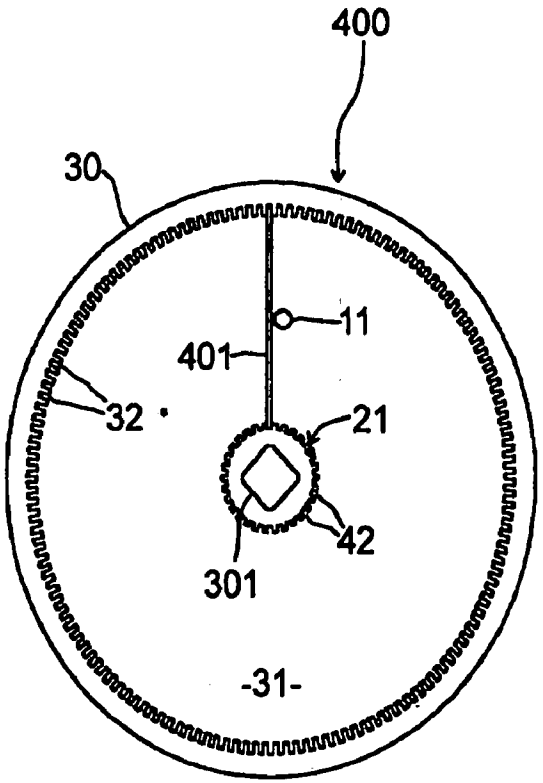
FIG. 11A
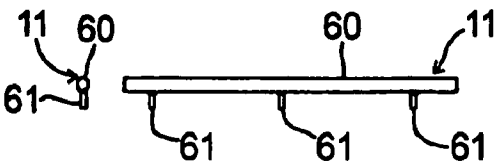
FIG. 13A
FIG. 13B
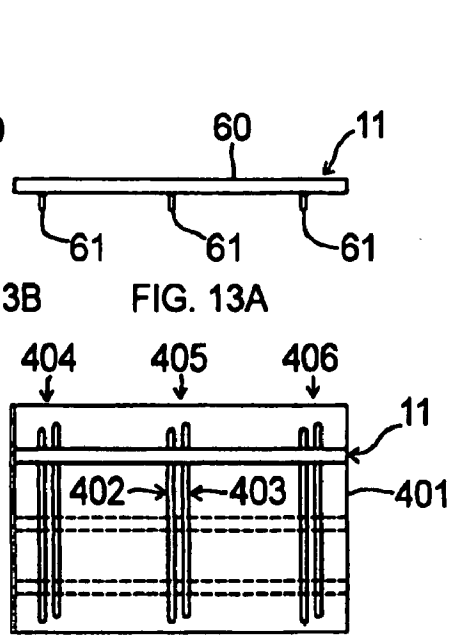
FIG. 12

FORMER ASSOCIATED WITH AN APPARATUS FOR MAKING CAGES

FIELD OF THE INVENTION

The present invention relates generally to a former for a cage-making machine which is adapted to hold a plurality of longitudinally extending rods and, in particular, to a former which is adapted to hold a plurality of longitudinally extending reinforcing rods.

The invention has been developed primarily for use with cage-making machines which are adapted for use in the construction of reinforcing cages for reinforcing concrete and will be described hereinafter with reference to this application. However, it will be appreciated that the invention is not limited to this particular use.

DESCRIPTION OF THE PRIOR ART

Some cage-making machines which are adapted for constructing reinforcing cages for reinforcing concrete utilise a former which is mounted on the machine. The former is adapted to hold a plurality of longitudinally extending reinforcing rods during the construction of a reinforcing cage. In particular, the former is adapted to hold the rods such that the rods are maintained in a particular transverse relationship with respect to each other. Cage-making machines which employ formers of this type are usually operated by firstly inserting a plurality of longitudinally extending reinforcing rods into the former. The rods are then progressively withdrawn from the former as a reinforcing cage is constructed. Construction of the cage typically involves winding a reinforcing bar around the withdrawn portions of the rods while simultaneously welding or otherwise attaching the bar to the rods.

A reinforcing cage manufacturer will usually have a number of formers on-hand with each former being adapted for use in the construction of a reinforcing cage having a particular arrangement of longitudinally extending reinforcing rods. There are a number of significant disadvantages associated with formers of this type.

One disadvantage is that, since cage-making machines usually permit only one former to be mounted thereon, it is often necessary to provide a sufficient amount of storage space to store the formers which are not in use.

A further disadvantage is that the manufacturer will often have to replace the former mounted on its cage-making machine with a diff rent former in order to produce a cage having a different arrangement of longitudinally extending reinforcing rods.

When a cage manufacturer transports its cage-making machine to a construction site, the manufacturer will often have to transport more than one former so that cages having different arrangements of longitudinally extending reinforcing rods can be constructed on-site. Transporting more than one former usually results in increased transportation costs.

Also, it often occurs that a manufacturer will not have a former on-hand which is suitable for constructing a cage having a particular arrangement of longitudinally extending reinforcing rods. Therefore, the manufacturer must either obtain a suitable former or somehow modify an existing former.

U.S. Pat. No. 4,625,773 (Pfender) discloses a machine for fabricating a reinforcing body or cage for a concrete pipe. The machine includes an axially stationary main wheel, an axially mobile support wheel mounted coaxially and drivable synchronously with the main wheel, a hub received by the main wheel, and a plurality of spokes radiating from the hub to the main wheel. Radially adjustable guide pieces are carried by the spokes and are used for supporting longitudinal rods of the cage which are to be welded to a wire which is wound around the rods. The transverse locations of the longitudinal rods relative to the main wheel and the hub are able to be adjusted by repositioning the radially adjustable guide pieces relative to the spokes so that the machine can be used for fabricating different types of cages.

It is an object of the present invention to substantially overcome, or at least ameliorate, one or more of the disadvantages associated with the prior art.

SUMMARY OF THE INVENTION

According to a first aspect of the present invention there is provided a former for holding a plurality of longitudinally extending rods and for use with a cage-making machine which is used for fabricating reinforcing cages for reinforcing concrete, the former including:

an inner frame member;

an outer frame member;

a plurality of transverse frame members located around a perimeter of the inner frame member and extending between the inner frame member and the outer frame member; and a plurality of rod supports for holding the rods, wherein the rod supports are secured relative to the transverse frame members, and wherein the transverse location of at least one of the rod supports is able to be adjusted relative to the transverse frame member to which the at least one of the rod supports is secured, the former being characterised in that the transverse location of at least one of the transverse frame members is able to be adjusted relative to the inner frame member and the outer frame member such that the at least one of the transverse frame members is able to radiate from a particular location on the perimeter of the inner frame member towards any one of a plurality of locations on the outer frame member.

Preferably, an aperture substantially extends through the outer frame member; and the inner frame member is recieved by the aperature in the outer frame member.

Advantageously, the outer frame member is a cylinder and the aperture in the outer frame member extends longitudinally through the outer frame member.

Preferably, the radial location of at least one of the rod supports between the inner frame member and the outer frame member is able to be adjusted.

In a preferred form, at least one of the transverse frame members extends radially between the inner frame member and the outer frame member.

At least one of the transverse frame members is skewed relative to a radially extending position between the inner frame member and the outer frame member.

Advantageously, an aperture extends through the inner frame member. The aperture which extends through the inner frame member may be adapted to enable an axle which has a non-circular transverse cross-section to rotatably lock with the inner frame member. The aperture which extends through the inner frame member may have a non-circular transverse cross-section. For example, the aperture which extends through the inner frame member may have a rectangular transverse cross-section.

Preferably, the transverse frame members are removably mounted between the inner frame member and the outer frame member. The inner frame member and the outer frame member may each include locating formations which are adapted to locate the removable transverse frame members relative to the inner frame member and the outer frame member. Preferably, the locating formations of the inner frame member are located opposite an inside surface of the outer frame member, and the locating formations of the outer frame member are located opposite an outer surface of the inner frame member. Each of the locating formations may be in the form of a groove which is adapted to receive an associated one of the transverse frame members. In particular, each of the locating formations may be a radial groove. Each of the locating formations of the outer frame member may be in the form of a locating aperture which extends through a side of the outer frame member. Each of the locating apertures are adapted to receive the transverse frame members. Each of the locating apertures may extend radially through a side of the outer frame member. Preferably, the locating formations of the inner and outer frame members are adapted to enable at least one of the transverse frame members to be skewed relative to a radially extending position between the inner and outer frame members.

Advantageously, each of the transverse frame members is in the form of a plate. Each of the transverse frame members may include a plurality of mounting apertures The mounting apertures are preferably elongate. The mounting apertures are preferably adapted to enable at least one of the rod supports to be removably secured to the plate.

The rod supports may be tubes.

In order that the invention may be more fully understood and put into practice, a preferred embodiment thereof will now be described with reference to the accompanying drawings.

BRIEF DESCRIPTION OF THE DRAWINGS

FIG. 1A is an end elevation of a former according to a first embodiment of the present invention;

FIG. 1B is a side elevation of the former illustrated in FIG. 1A;

FIG. 2A is a side elevation of a transverse frame member which is used in the former illustrated in FIGS. 1A and 1B;

FIG. 2B is an end elevation of the transverse frame member illustrated in FIG. 2A;

FIG. 3A is a side elevation of a rod support which is used in the former illustrated in FIGS. 1A and 1B;

FIG. 3B is an end elevation of the rod support illustrated in FIG. 3A;

FIG. 11A is an end elevation of a former according to a fifth embodiment of the present invention;

FIG. 11B is a side elevation of the former illustrated in FIG. 11A;

FIG. 12 is a side elevation of a transverse frame member and rod support which are used in the former illustrated in FIGS. 11A and 11B;

FIG. 13A is a side elevation of a rod support which is used in the former illustrated in FIGS. 11A and 11B;

FIG. 13B is an end elevation of the rod support illustrated in FIG. 13A.

DETAILED DESCRIPTION

Figure 4:
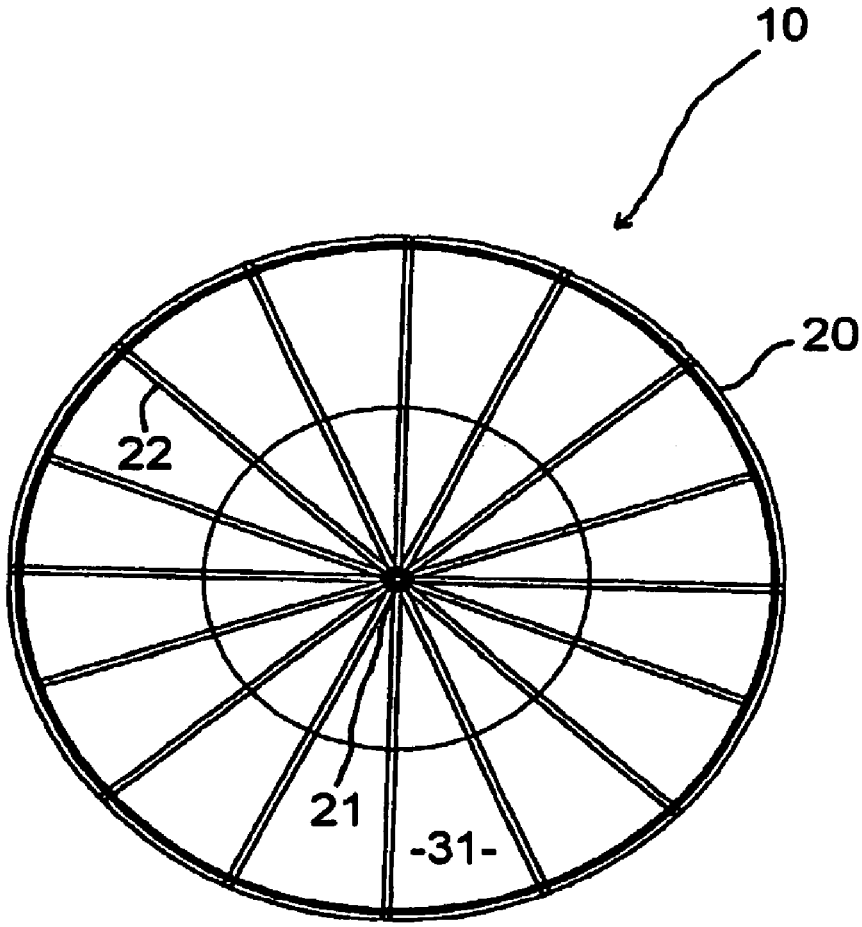
FIG. 4 is a simplified end elevation of the former illustrated in FIGS. 1A and 1B which shows the former with a plurality of transverse frame members.

A first embodiment of a former is illustrated in FIGS. 1A and 1B and is designated generally as 10. The former 10 is adapted to hold a plurality of longitudinally extending rods. The former 10 includes a frame and a plurality of rod supports 11 that are each adapted to hold an associated said longitudinally extending rod. The rod supports 11 are mounted to the frame such that the transverse location of the rod supports 11 can be varied relative to the frame.

The frame includes an outer frame member 20, an inner frame member 21 and a plurality of transverse frame members 22 (note that only one is shown) extending between the outer and inner frame members 20, 21.

The rod supports 11 are mounted to the transverse frame members 22. The outer frame member 20 is in the form of a cylinder having flanges 30 located at either end. An aperture 31 extends longitudinally through the outer frame member 20. A plurality of locating formations in the form of radially extending grooves 32 are evenly distributed around an inner surface of the outer frame member 20. Grooves 32 extend the length of the outer frame member 20 or, alternatively, the grooves 32 may only extend through the flanges 30. Grooves 32 are substantially parallel with respect to a longitudinal axis of the outer frame member 20.

The inner frame member 21 is also in the form of a cylinder. The length of the inner frame member 21 is substantially equal to the length of the outer frame member 20. A plurality of locating formations in the form of radially extending grooves 42 are evenly distributed around an outer surface of the inner frame member 21. Grooves 42 extend the length of the inner frame member 21. Alternatively, the grooves 42 may extend through a plurality of rings which are mounted at spaced locations on the inner frame member 21. Grooves 42 are substantially parallel with respect to a longitudinal axis of the inner frame member 21.

The inner frame member 21 is coaxial with the outer frame member 20. Aperture 31 receives the inner frame member 21 such that the inner frame member 21 is spaced from the outer frame member 20. Each groove 42 of the inner frame member 21 is aligned with an associated groove 32 of the outer frame member 20.

Referring to FIGS. 2A and 2B, each transverse frame member 22 is generally in the form of a rectangular plate. The length of each transverse frame member 22 is substantially equal to the length of the outer and inner frame members 20, 21. The width of each transverse frame member 22 is such that the transverse frame members 22 can be mounted between the outer and inner frame members 20, 21. Each transverse frame member 22 includes a plurality of mounting apertures 50 extending therethrough. The mounting apertures 50 are arranged into three main banks 51 to 53 with each main bank 51 to 53 being formed from two minor banks 54 and 55 which are offset from one another.

Referring to FIGS. 3A and 3B, each rod support 11 is adapted to slidably receive a longitudinally extending rod. Each rod support 11 includes a tube 60 and a plurality of lugs 61 extending perpendicularly therefrom. Lugs 61 are aligned with each other and are spaced along the length of the tube 60. A threaded aperture extends into each lug 61 from a free end thereof. The threaded apertures enable a bolt to be screwed into each lug 61. The distance between each adjacent pair of lugs 61 is equal to the distance between an associated pair of adjacent and like minor banks (i.e. minor bank 54 or 55). Also, the dimensions of the lugs 61 are such that each lug 61 can be received by a mounting aperture 50. A rod support 11 is mounted to a transverse frame member 22 by inserting each lug 61 into an associated mounting aperture 50 of each main bank 51 to 53. Once the lugs 61 are inserted into the transverse frame member 22, the rod support 11 is secured to the transverse frame member 22 by screwing a bolt into the threaded aperture of each lug 61. The mounting location of the rod supports 11 on the transverse frame member 22 can be varied by choosing different mounting apertures 50.

Again referring to FIGS. 1A and 1B, a single transverse frame member 22 having a plurality of rod supports 11 mounted thereto is shown removably mounted between the outer and inner frame members 20, 21. The rod supports 11 are mounted to the transverse frame member 22 such that they are substantially parallel to a longitudinal axis of both the outer and inner fram members 20, 21. Further, the rod supports 11 are located on either side of the transverse frame member 22 such that the rod supports 11 on one side of the transverse frame member 22 are offset from the rod supports 11 on the opposite side of the transverse frame member 22.

The transverse frame member 22 is mounted between the outer and inner frame members 20, 21 by aligning each longitudinal edge of the transverse frame member 22 with an associated groove 32 or 42 and then sliding the transverse frame member 22 between the outer and inner frame members 20, 21. Each groove 32, 42 is adapted to receive a longitudinal edge of the transverse frame member 22 such that the transverse frame member 22 is positively located relative to the outer and inner frame members 20, 21.

The transverse frame member 22 is able to be mounted such that it extends radially between the outer and inner frame members 20, 21. In this case the longitudinal edges of the transverse frame member 22 are received by aligned grooves 32,42.

Although FIG. 1A only shows a single transverse frame member 22, a plurality of transverse frame members 22 will normally be mounted between the outer and inner frame members 20, 21. The transverse frame members 22 typically support the inner frame member 21 within the outer frame member 20. However, the inner frame member 21 may be supported within the outer frame member 20 by some other means so that the inner frame member 21 maintains its position relative to the outer frame member 20 even if all of the transverse frame members 22 are removed from between the outer and inner frame members 20, 21.

FIG. 4 illustrates the former 10 when a plurality of transverse frame members 22 are mounted between the outer and inner frame members 20, 21. The transverse frame members 22 extend radially between the outer and inner frame members 20, 21.

Figure 5:
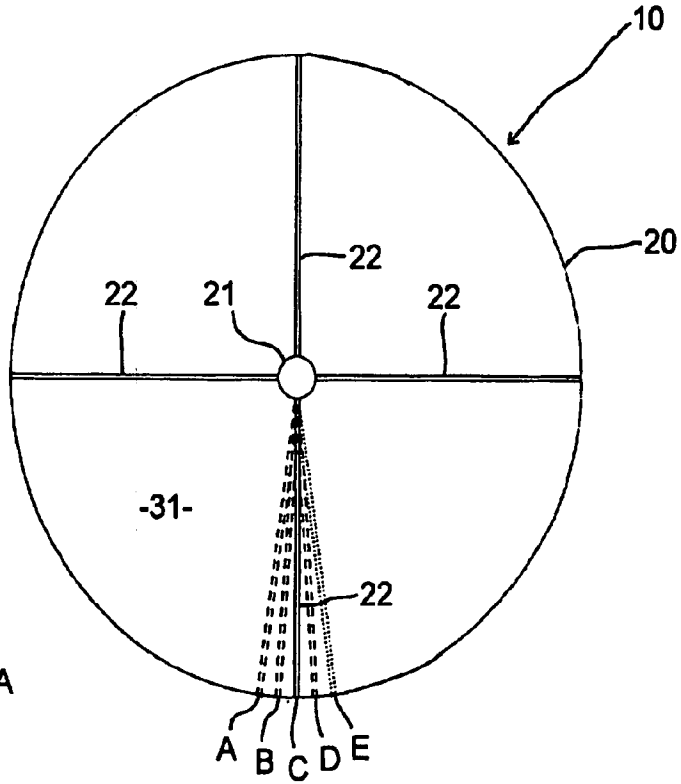
FIG. 5 is a simplified end elevation of the former illustrated in FIG. 1A which shows how the skewing of a transverse frame member can be achieved.

Referring to FIG. 5, the former 10 is shown having four transverse frame members 22 mounted between the outer and inner frame members 20, 21. As previously mentioned, each groove 32 of the outer frame member 20 is aligned with an associated groove 42 of the inner frame member 21. Thus, when a transverse frame member 22 is mounted between the outer and inner frame members 20, 21 by aligned grooves 32, 42, the transverse member 22 will extend radially between the outer and inner frame members 20, 21. However, grooves 32, 42 are adapted so that the transverse frame members 22 can be mounted in grooves 32, 42 which are not aligned with each other. This enables the transverse frame members 22 to be mounted such that they do not extend radially between the outer and inner frame members 20, 21 and are slightly skewed. In other words, the inclination of the transverse frame members 22 relative to the outer and inner frame members 20, 21 can be varied. As an example, grooves 32, 42 may be adapted to enable the transverse frame members 22 to be mounted between the outer and inner frame members 20, 21 in any one of the illustrated positions A, B, C, D or E.

Figure 6A:
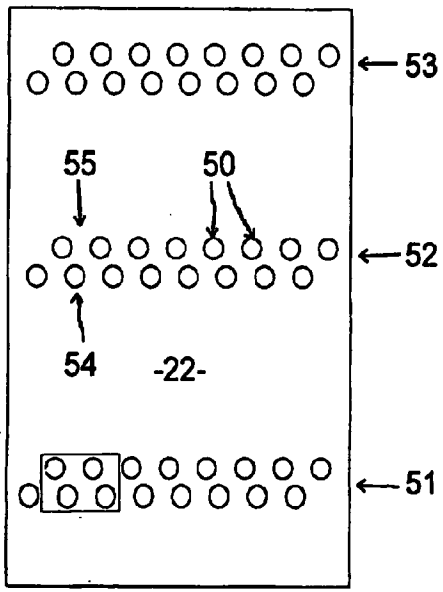
FIG. 6A is a side elevation of a transverse frame member which is used in the former illustrated in FIG. 5.
Figure 6B:
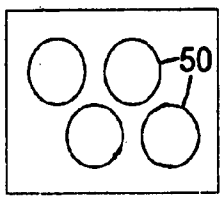
FIG. 6B is a magnified view of a portion of the transverse frame member illustrated in FIG. 6A.

FIGS. 6A and 6B further illustrate the transverse frame member 22 used in the former 10.

Figure 7A:
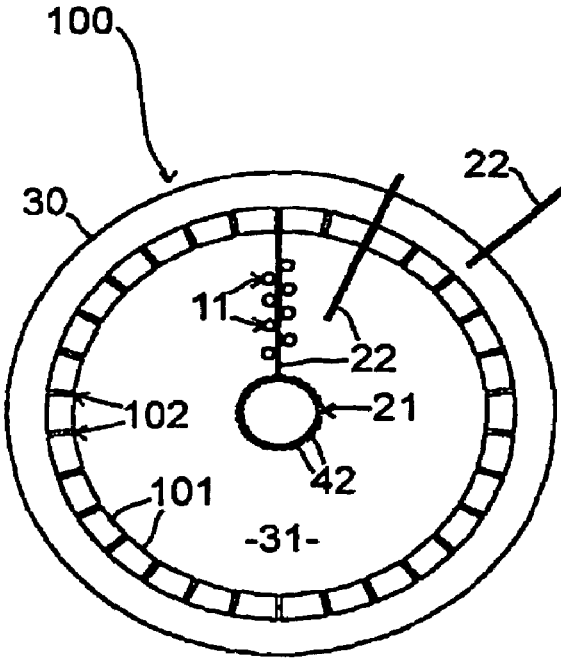
FIG. 7A is an end elevation of a former according to a second embodiment of the present invention.
Figure 7B:
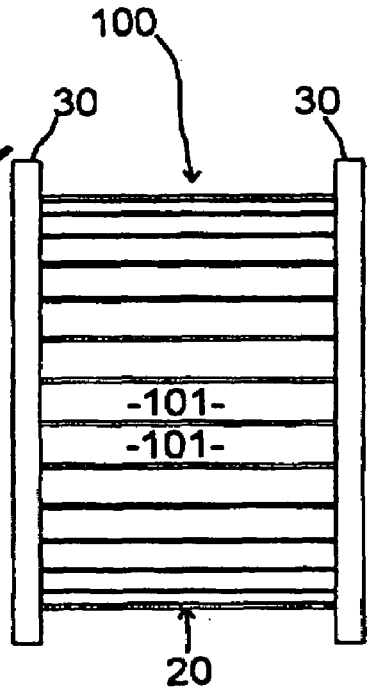
FIG. 7B is a side elevation of the former illustrated in FIG. 7A.

A second embodiment of a former is illustrated in FIGS. 7A and 7B and is designated generally as 100. For convenience, features of the former 100 that are similar or correspond to features of the former 10 have been referenced using the same reference numbers.

The outer frame member 20 is generally in the form of a cylinder having flanges 30 located at either end. The cylinder is constructed from a plurality of longitudinally extending elongated members 101, wherein each elongated member 101 has a substantially rectangular transverse cross-section. Flanges 30 are provided by a pair of axially aligned rings that are spaced apart from each other. Each elongated member 101 extends between the rings and is suitably mounted to an inner surface of each ring. The elongated members 101 are mounted to the rings such that adjacent elongated members 101 are separated from each other by radial locating apertures 102 which function as locating formations. The locating apertures 102, which are identical to each other, extend the length of the outer frame member 20 and are substantially parallel with respect to a longitudinal axis of the outer frame member 20. The locating apertures 102 are evenly distributed around the perimeter of the outer frame member 20 and each locating aperture 102 is aligned with an associated groove 42 of the inner frame member 21.

There are two methods by which the transverse frame members 22 can be mounted between the outer and inner frame members 20, 21 of the former 100. The first method is identical to the method described in connection with the former 10. According to the second method, a transverse frame member 22 is inserted through an associated locating aperture 102 so that a longitudinal edge of the transverse frame member 22 is received by an associated groove 42 and an opposite longitudinal edge is received by an associated locating aperture 102. This second method is illustrated in FIG. 7A which shows three different transverse frame members 22 at various stages of insertion between the outer and inner frame members 20, 21. In order to use the second method, the rod supports 11 must be removed from the transverse frame members 22 before the transverse frame members 22 are able to pass through the locating apertures 102. The transverse frame members 22 need to be secured to the outer or inner frame members 20, 21 by a suitable means to prevent them from falling out of the former 100.

Grooves 42 and locating apertures 102 can be configured so that the inclination of the transverse frame members 22 relative to the outer and inner frame members 20, 21 can be varied.

Figure 8:
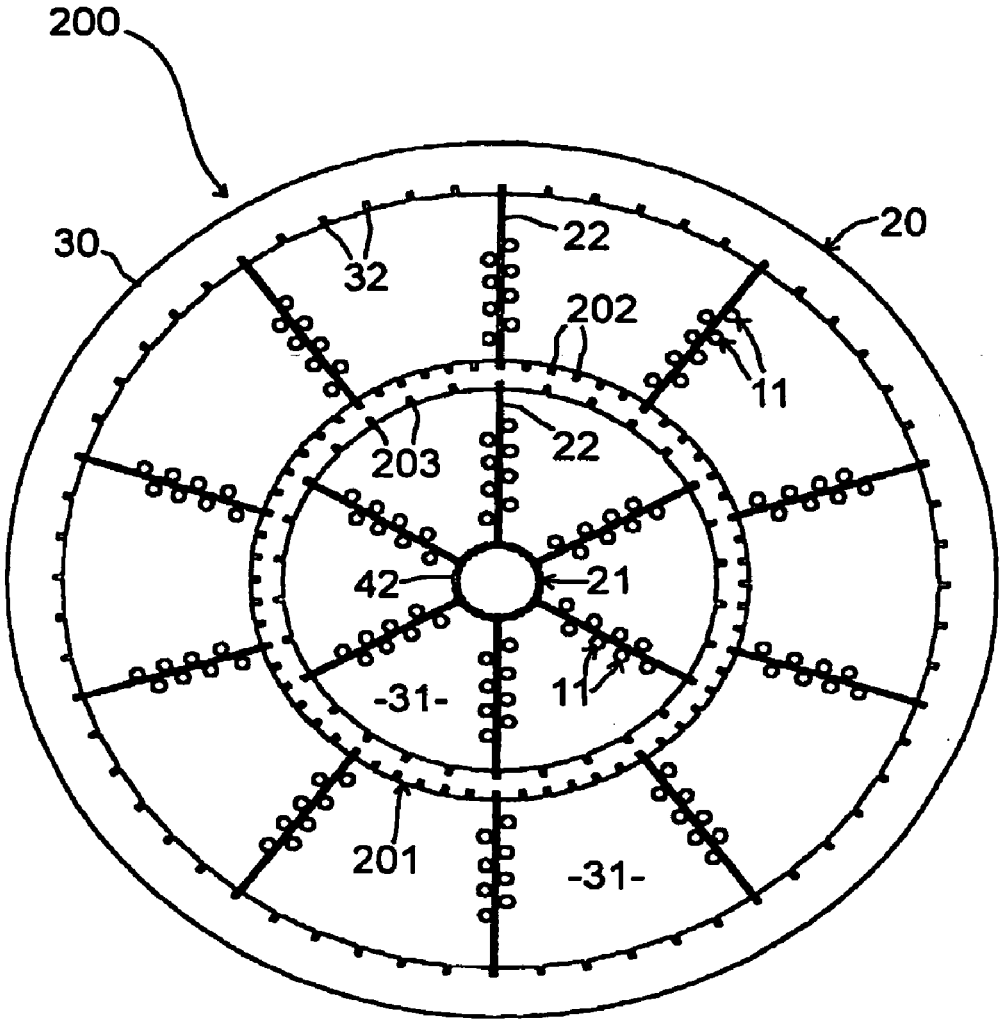
FIG. 8 is an end elevation of a former according to a third embodiment of the present invention.

A third embodiment of a former is illustrated in FIG. 8 and is designated generally as 200. For convenience, features of the former 200 that are similar or correspond to features of the previously described embodiments have been referenced using the same reference numbers.

Former 200 is similar to former 10 except that former 200 includes an intermediate frame member 201. Also, transverse frame members 22 extend between the intermediate and inner frame members 201, 21. Further, transverse frame members 22 extend between the intermediate and outer frame members 201, 20.

The intermediate frame member 201 has a similar configuration to the outer frame member 20 except that the intermediate frame member 201 has a plurality of locating formations in the form of radial grooves 202, 203 which are evenly distributed around an outer and inner surface, respectively, of the intermediate frame member 201. Grooves 202, 203 extend the length of the intermediate frame member 201 and are substantially parallel with respect to a longitudinal axis of the intermediate frame member 201. Each groove 202 of the intermediate frame member 201 is aligned with an associated groove 32 of the outer frame member 20. Also, each groove 203 of the intermediate frame member 201 is aligned with an associated groove 42 of the inner frame member 21.

Figure 9B:
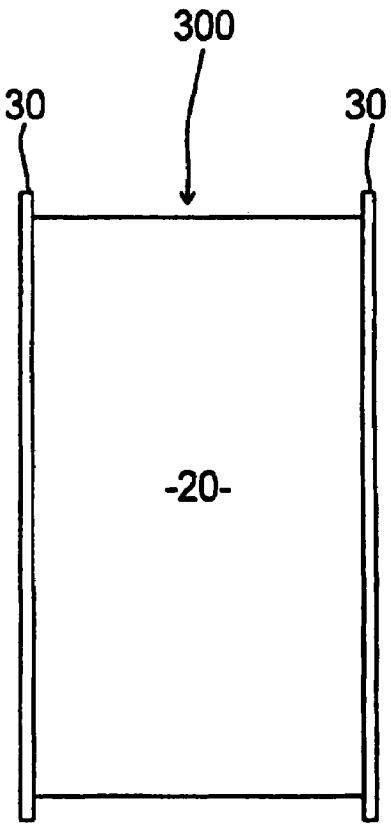
FIG. 9B is a side elevation of the former illustrated in FIG. 9A.
Figure 9A:
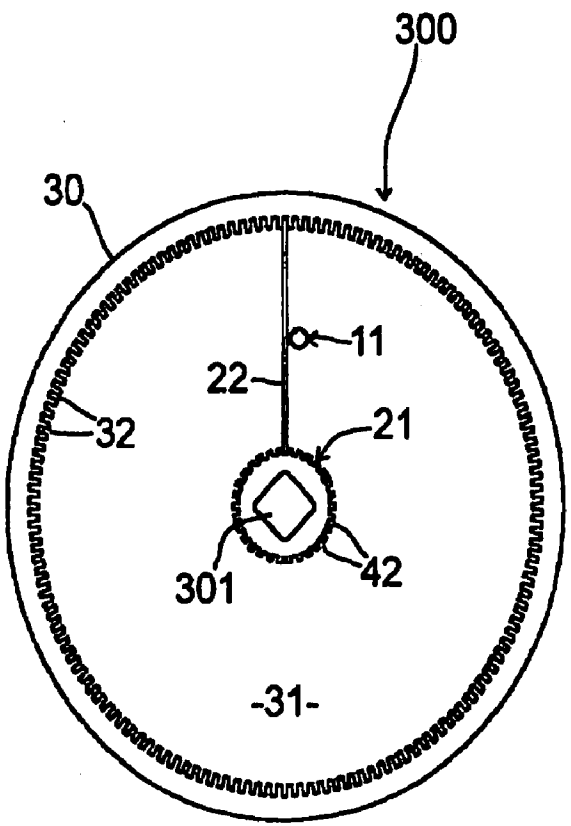
FIG. 9A is an end elevation of a former according to a fourth embodiment of the present invention.

A fourth embodiment of a former is illustrated in FIGS. 9A and 9B and is designated generally as 300. For convenience, features of the former 300 that are similar or correspond to features of the previously described embodiments have been referenced using the same reference numbers.

Former 300 is similar to former 10 except that former 300 includes an aperture 301 which extends through the inner frame member 21. The aperture 301 is adapted to enable an axle having a non-circular transverse cross-section to rotatably lock with the inner frame member 21. The aperture 301 has a rectangular transverse cross-section.

Figure 10:
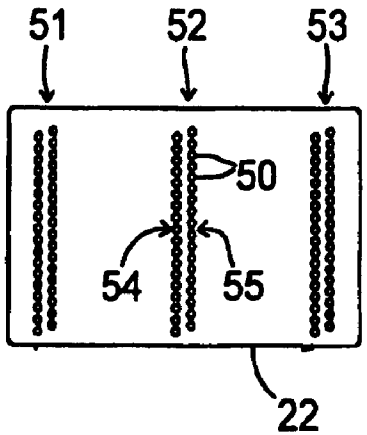
FIG. 10 is a side elevation of a transverse frame member which is used in the former illustrated in FIGS. 9A and 9B.

FIG. 10 illustrates the configuration of the transverse frame members 22 which are used in the former 300.

A fifth embodiment of a former is illustrated in FIGS. 11A and 11B and is designated generally as 400. For convenience, features of the former 400 that are similar or correspond to features of the previously described embodiments have been referenced using the same reference numbers.

Former 400 is similar to former 300 except that former 400 uses transverse frame members 401 which have a different configuration to the transverse frame members 22 used by former 300.

FIG. 12 details the configuration of the transverse frame member 401. Each transverse frame member 401 is generally in the form of a rectangular plate. The length of each transverse frame member 401 is substantially equal to the length of the outer and inner frame members 20, 21. The width of each transverse frame member 401 is substantially equal to the width of the gap between the outer and inner frame members 20, 21. Each transverse frame member 401 includes a plurality of elongated mounting apertures 402, 403 extending therethrough. The mounting apertures 402, 403 are arranged into three banks 404 to 406 with each bank 404 to 406 being formed from a pair of parallel mounting apertures 402, 403 which are offset from one another.

The rod support 11 illustrated in FIGS. 13A and 13B is identical to the rod support 11 illustrated in FIGS. 3A and 3B. The distance between each pair of adjacent lugs 61 is equal to the distance between an associated pair of adjacent and like mounting apertures 402, 403.

Rod support 11 is mounted to the transverse frame member 401 by inserting each lug 61 into an associated mounting aperture 402 or 403. Once the lugs 61 are inserted into the transverse frame member 401, the rod support 11 is secured to the transverse frame member 401 by screwing a bolt into the threaded aperture of each lug 61. The location of the rod support 11 relative to the transverse frame member 401 can be varied by sliding the lugs 61 within the apertures 402, 403. This change of location can be implemented manually or by a suitable mechanical means.

Figure 14:
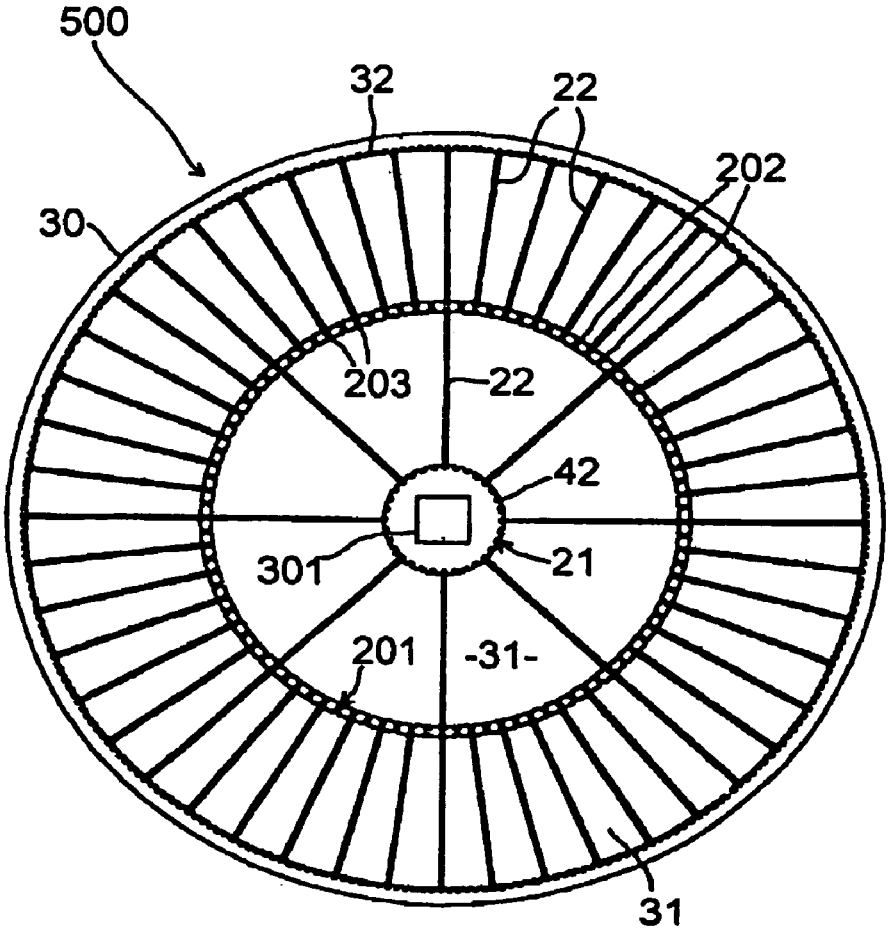
FIG. 14 is an end elevation of a former according to a sixth embodiment of the present invention.

A sixth embodiment of a former is illustrated in FIG. 14 and is designated generally as 500. For convenience, features of the former 500 that are similar or correspond to features of the previously described embodiments have been referenced using the same reference numbers.

Former 500 is similar to former 200 except that the inner frame member 21 of former 500 includes an aperture 301 in a similar manner to formers 300 and 400.

The invention claimed is:

1. A former for holding a plurality of longitudinally extending rods and for use with a cage-making machine which is used for fabricating reinforcing cages for reinforcing concrete, the former including:

an inner frame member;

an outer frame member;

a plurality of transverse frame members located around a perimeter of the inner frame member and extending between the inner frame member and the outer frame member; and a plurality of rod supports for holding the rods, wherein the rod supports are secured relative to the transverse frame members, and wherein the transverse location of at least one of the rod supports is able to be adjusted relative to the transverse frame member to which the at least one of the rod supports is secured, the former being characterised in that the transverse location of at least one of the transverse frame members is able to be adjusted relative to the inner frame member and the outer frame member such that the at least one of the transverse frame members is able to radiate from a particular location on the perimeter of the inner frame member towards any one of a plurality of locations on the outer frame member.

2. The former of claim 1, wherein an aperture substantially extends through the outer frame member, and wherein the inner frame member is received by the aperture in the outer frame member.

3. The former of claim 2, wherein the outer frame member is a cylinder and the aperture in the outer frame member extends longitudinally through the outer frame member.

4. The former of claim 1, wherein the inner frame member is a cylinder.

5. The former of claim 1, wherein the radial location of at least one of the rod supports between the inner frame member and the outer frame member is able to be adjusted.

6. The former of claim 1, wherein at least one of the transverse frame members extends radially between the inner frame member and the outer frame member.

7. The former of claim 1, wherein at least one of the transverse frame members is skewed relative to a radially extending position between the inner frame member and the outer frame member.

8. The former of claim 1, wherein an aperture extends through the inner frame member.

9. The former of claim 8, wherein the aperture which extends through the inner frame member is adapted to enable an axle which has a non-circular transverse cross-section to rotatably lock with the inner frame member.

10. The former of claim 9, wherein the aperture which extends through the inner frame member has a non-circular transverse cross-section.

11. The former of claim 10, wherein the aperture which extends through the inner frame member has a rectangular transverse cross-section.

12. The former of claim 1, wherein the transverse frame members are removably mounted between the inner frame member and the outer frame member.

13. The former of claim 12, wherein both the inner frame member and the outer frame member include locating formations which are adapted to locate the removable transverse frame members relative to the inner frame member and the outer frame member.

14. The former of claim 13, wherein the locating formations of the inner frame member are located opposite an inside surface of the outer frame member, and the locating formations of the outer frame member are located opposite an outer surface of the inner frame member.

15. The former of claim 14, wherein each of the locating formations is in the form of a groove which is adapted to receive an associated one of the transverse frame members.

16. The former of claim 15, wherein each of the locating formations is a radial groove.

17. The former of claim 13, wherein each of the locating formations of the inner frame member is in the form of a groove which is adapted to receive an associated one of the transverse frame members, and each of the locating formations of the outer frame member is in the form of a locating aperture which extends through a side of the outer frame member, wherein the locating apertures are adapted to receive the transverse frame members.

18. The former of claim 17, wherein each of the locating apertures extends radially through a side of the outer frame member, and each of the locating formations of the inner frame member is a radial groove.

19. The former of claim 1, wherein each of the transverse frame members is in the form of a plate.

20. The former of claim 19, wherein each of the transverse frame members includes a plurality of mounting apertures.

21. The former of claim 20, wherein the mounting apertures are elongate.

22. The former of claim 20, wherein the mounting apertures are adapted to enable at least one of the rod supports to be removably secured to the plate.

23. The former of claim 1, wherein the rod supports are tubes.

24. The former of claim 23, wherein a plurality of lugs extend from each of the rod supports, wherein the lugs are adapted to be received by the transverse frame members.

* * * * *